US009609996B2

(12) United States Patent
Fauth et al.

(10) Patent No.: US 9,609,996 B2
(45) Date of Patent: Apr. 4, 2017

(54) METHOD FOR PUMPING A FLUID OUT OF AN AQUIFEROUS HOUSEHOLD DEVICE

(75) Inventors: Michael Fauth, Pleinfeld (DE); Erwin Oberstaller, Buttenwiesen (DE); Andreas Reiter, Finningen (DE); Roland Rieger, Rainau (DE)

(73) Assignee: BSH Hausgeräte GmbH, Munich (DE)

( * ) Notice: Subject to any disclaimer, the term of this patent is extended or adjusted under 35 U.S.C. 154(b) by 1046 days.

(21) Appl. No.: 13/131,610

(22) PCT Filed: Dec. 4, 2009

(86) PCT No.: PCT/EP2009/066402

§ 371 (c)(1),
(2), (4) Date: May 27, 2011

(87) PCT Pub. No.: WO2010/079021

PCT Pub. Date: Jul. 15, 2010

(65) Prior Publication Data

US 2011/0232702 A1 Sep. 29, 2011

(30) Foreign Application Priority Data

Dec. 19, 2008 (DE) ..... 10 2008 055 022

(51) Int. Cl.

| | |
|---|---|
| ***A47L 15/00*** | (2006.01) |
| *A47L 15/42* | (2006.01) |
| *D06F 39/08* | (2006.01) |

(52) U.S. Cl.

CPC ..... *A47L 15/0031* (2013.01); *A47L 15/4225* (2013.01); *A47L 2401/08* (2013.01);
(Continued)

(58) Field of Classification Search

CPC ..... A47L 15/0031; A47L 15/4225; A47L 2501/02; A47L 2501/05; A47L 2401/08; A47L 15/0028
(Continued)

(56) References Cited

U.S. PATENT DOCUMENTS 3,790,815 A * 2/1974 Karklys ..... 307/141
6,138,692 A * 10/2000 Kobos ..... A47L 15/0013 134/25.2
(Continued)

FOREIGN PATENT DOCUMENTS

BE EP 1669017 A1 * 6/2006 ..... A47L 15/0047
DE 4214188 A1 11/1993
(Continued)

OTHER PUBLICATIONS

Machine translation of DE 102004004104 A1, dated Jul. 2005.*
(Continued)

*Primary Examiner* — Michael Barr
*Assistant Examiner* — Kevin G Lee
(74) *Attorney, Agent, or Firm* — Michael E. Tschupp; Andre Pallapies

(57) ABSTRACT

In a method for pumping a fluid out of an aquiferous household device such as a dishwashing machine, a drain pump and a circulation pump are operated at least partially simultaneously to ensure that, in the event of an abrupt stop of the circulation pump, reverse flow that may cause filter cake formed by separating soiling and particles to loosen resulting in their re-soiling of the items to be cleaned. The speed of the circulation pump is lowered from a maximum speed to at least a minimum speed substantially without pressure surges before startup of the drain pump.

44 Claims, 2 Drawing Sheets

(52) U.S. Cl.
CPC ..... *A47L 2401/20* (2013.01); *A47L 2501/02* (2013.01); *A47L 2501/05* (2013.01); *D06F 39/085* (2013.01); *Y10T 137/0324* (2015.04)

(58) Field of Classification Search
USPC ..... 134/56 D
See application file for complete search history.

(56) References Cited

U.S. PATENT DOCUMENTS

| | | | | |
|---|---|---|---|---|
| 7,185,664 | B2 * | 3/2007 | Christman et al. | 134/115 R |
| 8,104,110 | B2 * | 1/2012 | Caudill et al. | 4/541.1 |
| 8,506,725 | B2 * | 8/2013 | Bragg | 134/56 D |
| 2006/0162744 | A1 * | 7/2006 | Walkden | 134/25.2 |
| 2006/0207632 | A1 * | 9/2006 | Lee | 134/25.2 |
| 2006/0237044 | A1 * | 10/2006 | Ferguson et al. | 134/34 |
| 2007/0181154 | A1 * | 8/2007 | Beer | A47L 15/0002 134/34 |
| 2009/0032061 | A1 | 2/2009 | Beer et al. | |
| 2009/0090394 | A1 * | 4/2009 | Kang | 134/22.18 |
| 2009/0211600 | A1 * | 8/2009 | Steiner et al. | 134/10 |

FOREIGN PATENT DOCUMENTS

| | | | | |
|---|---|---|---|---|
| DE | 19750266 | A1 | 5/1999 | |
| DE | EP 1219228 | A1 * | 7/2002 | A47L 15/4225 |
| DE | 102004004104 | A1 * | 7/2005 | A47L 15/0002 |
| DE | 102004050396 | A1 | 4/2006 | |
| DE | EP 1882438 | A1 * | 1/2008 | A47L 15/4204 |
| EP | 998872 | A1 * | 5/2000 | |
| EP | 0998872 | A1 | 5/2000 | |
| EP | 1882438 | A1 | 1/2008 | |
| EP | 1967121 | A1 | 9/2008 | |
| EP | 2058523 | A2 | 5/2009 | |

OTHER PUBLICATIONS

Machine translation of EP 1669017 A1, dated Jun. 2006.*

International Search Report PCT/EP2009/066402.

Foreign Patent Office Report DE10 2008 055 022.1.

Granting Decision RU 2011125655 dated Jan. 24, 2014.

* cited by examiner

METHOD FOR PUMPING A FLUID OUT OF AN AQUIFEROUS HOUSEHOLD DEVICE

BACKGROUND OF THE INVENTION

The invention relates to a method for pumping a fluid out of an aquiferous household device, in particular out of a household dishwashing machine.

Aquiferous household devices, like for instance household dishwashing machines, comprise a circulation pump, with which fluid is circulated in order to supply spray facilities, like for instance rotating spray arms, with which fluid can be applied to items to be cleaned. In order to convey the fluid out of the aquiferous household device after such a cleaning process has terminated, a drain pump is provided, which can be connected to a domestic waste water disposal system. To this end, in addition to the drain pump, the circulation pump is operated at least partially in parallel, i.e. a simultaneous operation of both pumps takes place. This ensures that, in the event of an abrupt stop of the circulation pump, the occurrence of a reverse flow is avoided in channels which connect the circulation pump to the spray facilities for spraying items to be cleaned, which may cause the filter cake forming during operation on filter facilities for separating soiling and particles to loosen and float again as result of the back-flowing fluid quantities, consequently resulting in the separated particles and soiling re-entering the circuit for supplying the spray facilities and thus re-soiling the items to be cleaned.

By way of example, reference is made in this context to EP 1 882 438 A1, which discloses a corresponding household dishwashing machine. To ensure an effective cleaning of the filter, it is proposed that the wash fluid be emptied using a circulation pump which operates at least at the start. Once again however in this patent both the circulation pump and also the drain pump are in operation, so that the solution results in the system consuming increased energy.

BRIEF SUMMARY OF THE INVENTION

It is therefore the object of the invention to demonstrate technical alternatives, with which this type of resoiling of items to be cleaned can be reliably prevented.

The object of the invention is based on a method for pumping a fluid out of an aquiferous household device, in particular a household dishwashing machine, wherein water is conveyed out of said aquiferous household device at least temporarily by the operation of a drain pump and water is circulated at least temporarily by the operation of a circulation pump.

Provision is made in accordance with the invention for the speed of the circulation pump to be lowered from a maximum speed at least to a minimum speed before start-up of said drain pump substantially without pressure surges. This enables a resoiling to be prevented in a surprisingly easy fashion, since a continual reduction in the speed of the circulation pump before start-up of the drain pump may be able to lower the fluid level to such a degree that no removal of the filter cake by back-flowing quantities of fluid can occur, since no pressure surge causing a reverse in flow can arise, which could loosen a filter cake from a filter facility.

Provision is made here in a development for the speed of the circulation pump to be reduced in at least two steps before operation of the drain pump.

Provision is made in a development for the speed of the circulation pump to be lowered in the first step from a maximum speed to a minimum speed before start-up of said drain pump. This is a particularly simple embodiment, which requires a particularly minimal outlay in terms of devices.

Provision is made here in a development for the speed of the circulation pump to be lowered in a first step at least temporarily linearly from the maximum speed to the minimum speed, i.e. with a temporarily constant rate. However, the speed of the circulation pump can also be reduced gradually from the maximum speed to the minimum speed with a plurality of steps or in accordance with an exponential function.

Provision is also made in a development for the speed of the circulation pump to be reduced from the maximum speed to the minimum speed essentially during a period of 3 to 30 seconds, in particular during a period of 10 to 15 seconds. This enables re-soiling to be excluded and at the same time enables the duration of a pumping process to be left approximately unchanged.

Provision is made in a development for the speed to be reduced from the minimum speed to 0 in a second step. This means that the operation of the circulation pump is fully adjusted. The duration of the pumping process can therefore be reduced to a minimum. Provision is made here in a development for a quantity of fluid to be pumped out after the second step by operation of the drain pump. This means that the drain pump and the circulation pump are not operated simultaneously.

Provision is made here in a development for a quantity of essentially between 0.5 and 3 liters, in particular between 1 and 2 liters, to be pumped out.

Provision is made here in a development for the circulation pump to be operated after deactivation of the drain pump. This means that operation of the circulation pump is interrupted at least once during the pumping process by a phase during which a pumping process is implemented using the drain pump.

Provision is made in a development for the drain pump to be operated at least temporarily with an average speed which lies between the maximum speed and the minimum speed, with which the circulation pump is operated. In particular, unwanted noise emissions from the conveyance of air are therefore avoided, since the circulation pump is operated at a speed which is matched to the remaining residual quantities of water in the aquiferous household device.

Provision is made here in a development for the dishwashing machine to be operated in a lower basket spray operation during operation at an average speed. In other words, the dishwashing machine comprises an upper and a lower spray facility, which are each assigned to an upper and a lower crockery basket, with operation being possible, during which either only the upper basket with the spray facility assigned thereto or the lower basket with the spray facility assigned thereto is operated. This ensures that possible dirt residues which have loosened are fed back to the filter facility.

Provision is made here in a development for the circulation pump to be operated essentially for a period of time between 5 and 60 seconds, in particular between 10 and 30 seconds.

Provision is also made in a development for the speed of the circulation pump to be reduced in at least two steps, if the circulation pump is operated after deactivating the drain pump. Cleaning of the filter facility can herewith be effected.

Provision is likewise made here in a development to reduce the speed of the circulation pump in a first step from a maximum speed at least to a minimum speed before operation of the drain pump, with, in one development, the speed of the circulation pump being reduced at least temporarily from the average speed to the minimum speed. The speed of the circulation pump can however also be reduced gradually from the average speed to the minimum speed with a plurality of steps or in accordance with to an exponential function.

Provision is made in a development for the speed of the circulation pump to be reduced from the maximum speed to the minimum speed essentially during a period of 3 to 60 seconds, in particular during a period of 8 to 12 seconds.

Provision is also made in a development to reduce the speed in a second step from the average speed to 0, i.e. to conclude the second step by stopping the circulation pump.

Provision is made in a development that after the second step, a second quantity of fluid is pumped out by operating the drain pump. Here the second quantity of fluid is less than the first quantity of fluid.

Provision is made in a development that the maximum speed of essentially between 2000 and 3000 revolutions per minute, in particular between 2300 and 2700 per minute, is selected. This provides for an energy-efficient operation of the circulation pump while simultaneously reducing noise emissions.

Provision is also made in a development for the minimum speed of essentially between 1200 and 1800 revolutions per minute, in particular between 1300 and 1700 revolutions per minute, to be selected.

Provision is made in a development for the average speed of essentially between 1500 and 2000 revolutions per minute, in particular between 1700 and 2300 revolutions per minute, to be selected. This provides for an energy-efficient operation of the circulation pump while simultaneously reducing noise emissions, since the speed of the correspondingly reduced quantity of fluid in the aquiferous household device is adjusted so that it ensures that no air bubbles are taken in by the circulation pump which may result in an unwanted noise generation.

Provision is finally made in a development for the drain pump and the circulation pump to be controlled using power electronics of the electronic control system. I.e. only power electronics are provided, which are used alternately to control the drain and circulation pump. Power electronics can therefore be spared, which reduces the component requirement. The power electronics can be embodied to control pump motors embodied as BLDC motors for instance.

The object of the invention is also achieved by an aquiferous household device, in particular a household dishwashing machine, at least comprising a drain pump, with which water can be conveyed out of the aquiferous household device at least temporarily and at least comprising a circulation pump, with which fluid can be circulated in the aquiferous household device, and comprising control means for controlling the drain pump and the circulation pump, with provision being made in accordance with the invention for the control means to be embodied to lower the speed of the circulation pump from a maximum speed to at least a minimum speed before start-up of said drain pump substantially without pressure surges.

Developments of the invention are specified in the subclaims.

BRIEF DESCRIPTION OF THE DRAWINGS

The invention is explained below with reference to a drawing, in which.

DETAILED DESCRIPTION OF PREFERRED EMBODIMENTS

Figure 1:
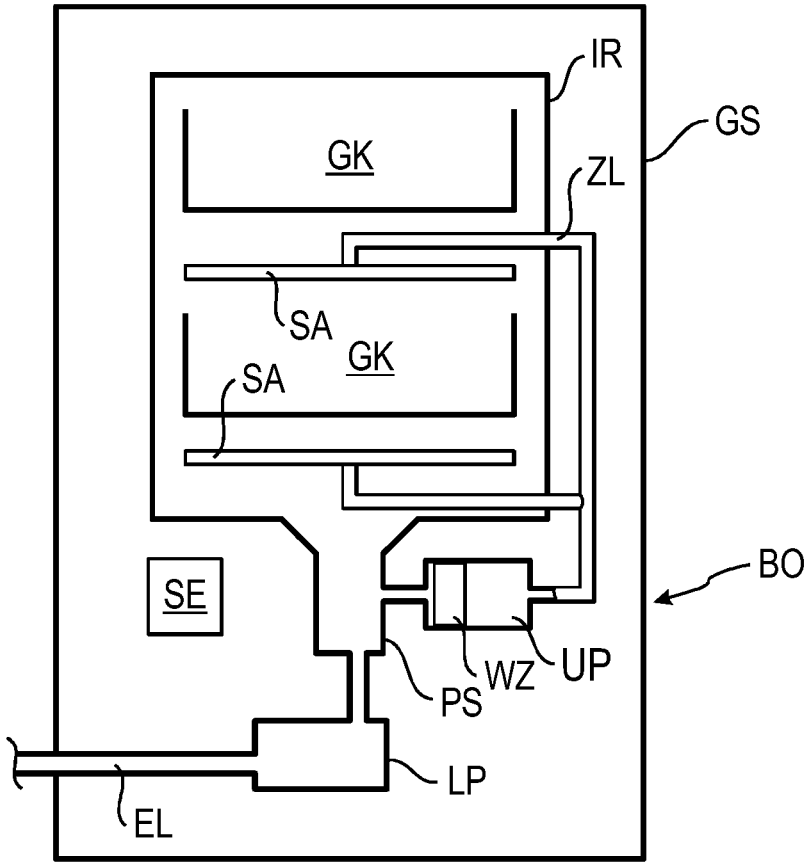
FIG. 1 shows a schematic representation of an aquiferous household device.

Reference is first made to FIG. 1.

An aquiferous household device embodied in the present exemplary embodiment as a household dishwashing machine GS comprises an interior IR serving as a washing container, it being possible to open and close said interior by means of a door (not shown) which is pivotably attached to the household dishwashing machine GS for loading and unloading purposes. Crockery baskets GK for receiving items to be cleaned are provided in the interior IR of the household dishwashing machine GS, with said items to be cleaned being removable from the interior IR of the household dishwashing machine GS in order to facilitate loading and unloading.

In order to clean the item to be cleaned which is stored in the crockery basket GK, spray facilities embodied as spray arms SA for applying fluid to the item to be cleaned are provided in the interior IR of the household dishwashing machine GS, with it being possible for the fluid to be water applied with detergent or rinse-aid for instance, in order thus to effect a cleaning effect and/or streak-free drying of the item to be cleaned. The fluid dripping from the item to be cleaned collects in a pump sump PS, which is arranged in the base region of the interior IR of the dishwashing machine GS. A filter facility (not shown) is also provided in the pump sump PS, with which soiling or particles can be separated out of the circulating fluid.

The spray arms SA are connected to a circulation pump UP in a fluid-conducting fashion by way of a supply line ZL, said circulation pump UP being arranged adjacent to other components of the household dishwashing machine GS in a base assembly BO below the interior IR of the household dishwashing machine GS. During operation, i.e. with a continuous circulation pump UP, the circulation pump UP takes in the fluid collecting in the pump sump PS and conveys it through the supply line ZL to the spray arms SA. To heat up the fluid circulated by operation of the circulation pump UP, the circulation pump UP in the present exemplary embodiment comprises an integrated water heating system WZ for heating up the fluid. Alternatively, a separate boiler or another water heating system may be provided for heating up the fluid. A drain pump LP is provided in order to empty the interior IR of the dishwashing machine GS, said drain pump LP likewise being connected in a fluid-conducting fashion to the pump sump PS and possibly being connected to a waste disposal line EL in a domestic waste disposal network.

The household dishwashing machine GS also comprises control means embodied as a control electronics system SE, which is embodied by means of line means (not shown) for controlling the circulation pump and the drain pump LP. To this end, the control electronics system SE can be embodied so as to control drive motors of the circulation pump UP and the drain pump LP which are embodied as BLDC motors. Corresponding power electronics (not shown) can be provided for each of the pumps or only one power electronics unit for both pumps, so that the one power electronics unit can be used to alternately control the drain pump LP or the circulation pump UP.

Figure 2:
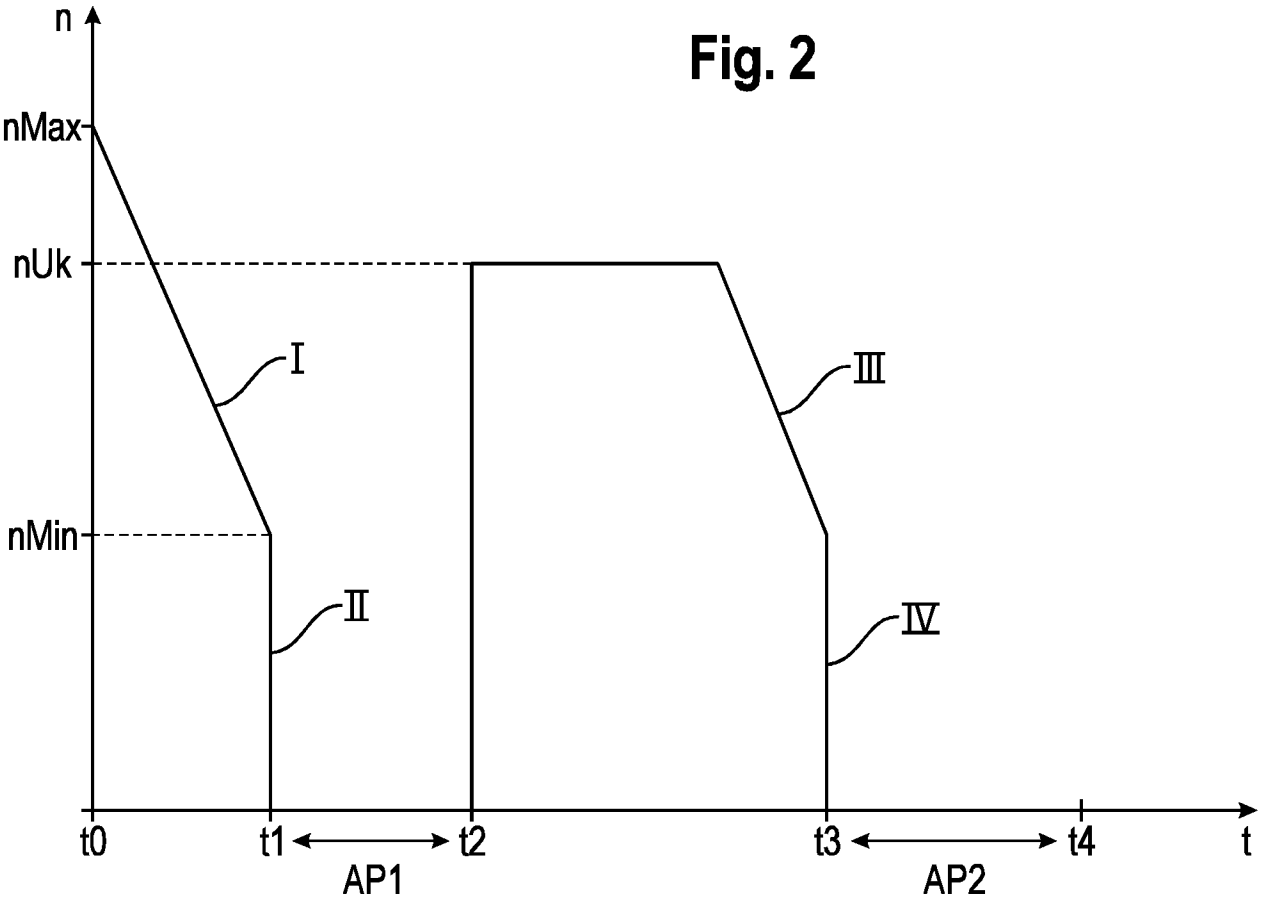
FIG. 2 shows a schematic representation of an exemplary embodiment of an inventive method for pumping a fluid out of an aquiferous household device.

Reference is now made to FIG. 1 and FIG. 2 together.

At the start of the pumping process, the speed of the circulation pump UP is reduced from a maximum speed nMax linearly during a first step I starting from time t0 to time t1 to a minimum speed nMin. In a step II, the speed is then reduced from nMin to zero, i.e. the circulation pump is stopped. This prevents a filter cake on the filter facility from loosening and floating, since the back-flowing quantity of fluid is no longer able to reach a level which approaches the filter facility.

A first pumping process AP1 then takes place, which extends from the time t1 to the time t2 and during which a quantity of 0.5 to 3 liters is pumped out for instance. Only the drain pump LP is operated during the first pumping phase AP1, while the circulation pump UP is deactivated and therefore has the speed 0.

After termination of the first pumping phase AP1, the drain pump LP is then deactivated, and the circulation pump UP is reactivated again. It is to this end operated with an average speed nUk. The household dishwashing machine GS is simultaneously operated in a lower crockery basket wash cycle, whereby only the lower spray arm SA of the two spray arms SA is operated.

Subsequently, in a step III for cleaning the filter, the speed of the circulation pump UP is then reduced linearly from the average speed nUk to the minimum speed nMin. In a further step IV, the speed at time t3 is then reduced from the minimum speed nMin to 0, i.e. the circulation pump UP is stopped.

A second pumping phase AP2 then takes place, which extends from time t3 to time t4, and during which a residual quantity of water is conveyed out of the household dishwashing machine GS by operation of the drain pump LP alone, with this second quantity of fluid being less than the first quantity of fluid, which was conveyed out of the aquiferous household device GS during the first pumping phase AP1.

The household dishwashing machine GS is then ready to be filled again.

LIST OF REFERENCE CHARACTERS

BO Base assembly
EL Waste disposal line
GK Crockery basket
GS Household dishwashing machine
IR Interior
LP Drain pump
PS Pump sump
SA Spray arm
t0 Time
t1 Time
t2 Time
t3 Time
t4 Time
UP Circulation pump
ZL Supply line
AP1 First pumping phase
AP2 Second pumping phase
nMax Maximum speed
nMin Minimum speed
nUk Average speed
SE Control electronics system
WZ Water heating system

The invention claimed is:

1. A method for pumping fluid out of an aquiferous household device having a circulation pump, a drain pump, and a control unit, said method comprising:

activating the circulation pump at a first of operational speed in a first operation and lowering the speed of the circulation pump over time to a second operational speed, substantially without pressure surges, starting the drain pump and deactivating the circulation pump once the circulation pump reaches the second operational speed, deactivating the drain pump after operating the drain pump for a first predetermined period that drains a first quantity of the fluid, reactivating the circulation pump, deactivating the circulation pump after operating for a second predetermined period, and reactivating the drain pump at the conclusion of the second predetermined period to drain a second quantity of the fluid.

2. The method of claim 1, wherein the aquiferous household device is a household dishwashing machine.

3. The method of claim 1, wherein the speed of the circulation pump is reduced linearly from the first operational speed to the second operational speed.

4. The method of claim 1 wherein the speed of the circulation pump is reduced from the first operational speed to the second operational speed essentially during a period of 3 to 30 seconds.

5. The method of claim 1, wherein the first quantity is in a range between 0.5 and 3 liters.

6. The method of claim 5, wherein the first quantity is in a range between 1 and 2 liters.

7. The method of claim 1, wherein the circulation pump is operated at least temporarily at a third operational speed between the first operational speed and the second operational speed.

8. The method of claim 7, wherein the circulation pump is operated at a third operational speed during operation of the aquiferous household device in a lower basket wash cycle.

9. The method of claim 7, wherein the second predetermined period between 5 and 60 seconds.

10. The method of claim 9, wherein the second predetermined period is between 10 and 30 seconds.

11. The method of claim 7, wherein the speed of the circulation pump is linearly reduced from the third operational speed to the second operational speed during the second predetermined period.

12. The method of claim 1, wherein the speed of the circulation pump is reduced during the second predetermined period from the first operational speed to the second operational speed during a period of 3 to 30 seconds.

13. The method of claim 12, wherein the speed of the circulation pump is reduced during the second predetermined period from the first operational seed to the second operational speed during a period of 8 to 12 seconds.

14. The method of claim 11, wherein the speed is reduced from the third operational speed to 0 during the second predetermined period.

15. The method of claim 1, wherein the second quantity of fluid is equal to or less than the first quantity of the fluid.

16. The method of claim 1, wherein the first operational speed is essentially in the range between 2000 and 3000 revolutions per minute.

17. The method of claim 16, wherein the first operational speed is essentially in the range between 2300 and 2700 revolutions per minute.

18. The method of claim 1, wherein the second operational speed is essentially in the range between 1200 and 1800 revolutions per minute.

19. The method of claim 18, wherein the second operational speed is essentially in the range between 1300 and 1700 revolutions per minute.

20. The method of claim 7, wherein the third operational speed is essentially in the range between 1500 and 2000 revolutions per minute.

21. The method of claim 20, wherein the third operational speed is essentially in the range between 1700 and 2300 revolutions per minute.

22. The method of claim 1, wherein the drain pump and the circulation pump are controlled using power electronics of the control unit.

23. An aquiferous household device comprising:

a circulation pump adapted to circulate fluid in the aquiferous household device;

a drain pump adapted to convey the fluid out of the aquiferous household device; and a control unit configured to perform a pumping-out operation to pump the fluid out of the household device by activating the circulation pump at a first operational speed in a first operation and lowering the speed of the circulation pump over time to a second operational speed, substantially without pressure surges, starting the drain pump and deactivating the circulation pump once the circulation pump reaches the second operational speed, deactivating the drain pump after operating the drain pump for a first predetermined period that drains a first quantity of the fluid, reactivating the circulation pump, deactivating the circulation pump after operating for a second predetermined period, and reactivating the drain pump at the conclusion of the second predetermined period to drain a second quantity of the fluid.

24. The device of claim 23, wherein the aquiferous household device is a household dishwashing machine.

25. The device of claim 23, wherein the control unit is configured to linearly reduce the speed of the circulation pump from the first operational speed to the second operational speed.

26. The device of claim 23, wherein the speed of the circulation pump is adapted to be reduced from the first operational speed to the second operational speed essentially during a period of 3 to 30 seconds.

27. The device of claim 26, wherein the speed of the circulation pump can be reduced from the first operational speed to the second operational speed essentially during a period in the range of 10 to 15 seconds.

28. The device of claim 23, wherein the first quantity is in a range between 0.5 and 3 liters.

29. The device of claim 23, wherein the first quantity is in a range between 1 and 2 liters.

30. The device of claim 23, wherein the circulation pump is operated at least temporarily at a third operational speed between the first operational speed and the second operational speed.

31. The device of claim 30, wherein the circulation pump is operated at the third operational-speed during operation of the aquiferous household device in a lower basket wash cycle.

32. The device of claim 30, wherein the second predetermined period is between 5 and 60 seconds.

33. The device of claim 31, wherein the second predetermined period is between 10 and 30 seconds.

34. The device of claim 30, wherein the control unit is configured to linearly reduce the speed of the circulation pump, during the second predetermined period from the third operational speed to the second operational speed.

35. The device of claim 30, wherein the control unit is configured to reduce the speed of the circulation pump during the second predetermined period from the third operational speed to the second operational speed during a period of 3 to 30 seconds.

36. The device of claim 30, wherein the control unit is configured to reduce the speed of the circulation pump during the second predetermined period from the third operational speed to the second operational speed during a period of 8 to 12 seconds.

37. The device of claim 34, wherein the control unit is configured to reduce the speed during the second predetermined period from the third operational speed to 0.

38. The device of claim 23, wherein the second quantity of the fluid is equal to or less than the first quantity of the fluid.

39. The device of claim 23, wherein the circulation pump is operated with a maximum speed essentially in the range between 2000 and 3000 revolutions per minute.

40. The device of claim 39, wherein the circulation pump is operated with a maximum speed essentially in the range between 2300 and 2700 revolutions per minute.

41. The device of claim 23, wherein the circulation pump is operated with a minimum speed essentially in the range between 1200 and 1800 revolutions per minute.

42. The device of claim 30, wherein the circulation pump is operated, during the second predetermined period, with an average speed essentially in the range between 1500 and 2000 revolutions per minute.

43. The device of claim 30, wherein the circulation pump is operated, during the second predetermined period, with an average speed essentially in the range between 1700 and 2300 revolutions per minute.

44. The device of claim 23, wherein the control unit includes a power electronics configured to control the drain pump and the circulation pump.

* * * * *